US005943536A

United States Patent [19]

Okada et al.

[11] Patent Number: 5,943,536

[45] Date of Patent: Aug. 24, 1999

[54] IMAGE FORMING APPARATUS

[75] Inventors: Tomoaki Okada, Hiroshima; Hitoshi Hirose, Mihara, both of Japan

[73] Assignee: Mitsubishi Heavy Industries, Ltd., Tokyo, Japan

[21] Appl. No.: 09/137,286

[22] Filed: Aug. 20, 1998

[30] Foreign Application Priority Data

Aug. 20, 1997 [JP] Japan ..... 9-223508

[51] Int. Cl.[6] ..... G03G 15/10

[52] U.S. Cl. ..... 399/239; 399/249

[58] Field of Search ..... 399/237, 239, 399/240, 241, 249; 430/117–119

[56] References Cited

U.S. PATENT DOCUMENTS

| | | | |
|---|---|---|---|
| 4,021,586 | 5/1977 | Matkan | 430/117 |
| 4,327,664 | 5/1982 | Ohkawa et al. | 399/240 |
| 4,686,936 | 8/1987 | Chow | 399/239 |
| 4,707,112 | 11/1987 | Hartmann | 399/241 |
| 5,289,238 | 2/1994 | Lior et al. | 399/249 |
| 5,398,105 | 3/1995 | Kuriu et al. | 399/241 |
| 5,477,313 | 12/1995 | Kuramochi et al. | 399/239 |
| 5,826,149 | 10/1998 | Horii et al. | 399/240 |

FOREIGN PATENT DOCUMENTS 01-237579 9/1989 Japan .

*Primary Examiner*—Robert Beatty
*Attorney, Agent, or Firm*—Alston & Bird LLP

[57] ABSTRACT

An electric field applying device is disposed in a position opposite to a surface of rotary developing device within an area defined between the surface of the developing means and a position of scratching device after the surface of the developing device passes through a developing area so as to apply an electric field in a direction in which ions having the polarity opposite to that of toner particles are separated from the surface of the developing device.

8 Claims, 8 Drawing Sheets

IMAGE FORMING APPARATUS

FIELD OF THE INVENTION AND RELATED ART STATEMENT

The present invention relates to an image forming apparatus and more particularly to an image forming apparatus suitable for an on-demand type wet color image forming apparatus.

A conventional on-demand type image forming apparatus which uses liquid developing solution and records an image onto a transfer material by means of an electrophotographic method generally is structured as shown in FIG. 11.

In FIG. 11, numeral 1 denotes an image carrying body constituted by a photosensitive drum. The image carrying body 1 is rotated in the direction (clockwise) shown by an arrow in FIG. 11. A charging device 2, an exposure device 3, a rotary developing device (developing electrode) 4, a squeezing device 5, a transferring device 6, a cleaning blade 7 and a neutralizing device 8 are disposed around the image carrying body 1 in order along a rotational direction of the image carrying body 1. The charging device 2 is connected to a power supply not shown and the transferring device 6 employs a corona charger and is connected to a power supply $E_2$.

Operation of the image forming apparatus of FIG. 11 is now described. The surface (photosensitive surface) of the image carrying body 1 is charged to, for example, a positive polarity (+) by the charging device 2 when the image carrying body 1 is rotated. The surface of the image carrying body 1 is then is exposed by the exposure device 3 so that an electrostatic latent image 10 is formed on the surface. Liquid developing solution 11 is applied on the surface of the image carrying body 1 by means of the rotary developing device (developing electrode) 4, so that a toner image 12 is formed on the surface of the image carrying body 1 on the basis of the electrostatic latent image 10. The liquid developing solution 11 includes toner particles charged to a positive polarity (+) or a negative polarity (−) and dispersed in insulative liquid. In this example, the toner particles are charged to a positive polarity (+). Accordingly, the liquid developing solution 11 is supplied from the developing device 4 to the electrostatic latent image 10 of the image carrying body 1, so that the positive (+) toner particles contained in the liquid developing solution 11 are electrophoresed to the electrostatic latent image 10 to thereby perform development.

Then, after the development, remaining or surplus insulative liquid in the liquid developing solution 11 remaining on the image carrying body 1 is removed by means of the squeezing device 5. Thereafter, a transfer material 13 is moved to the image carrying body 1 by a conveying roller 14 and electric charges of an opposite polarity to that of the toner particles of the toner image, for example, negative (−) electric charges are applied to the transfer material 13 from the rear surface thereof by means of the transferring device 6 so that the toner particles forming the toner image 12 on the image carrying body 1 are sucked onto the transfer material 13 so that the toner image 12 is transferred onto the transfer material 13. Thereafter, toner particles remaining on the surface of the image carrying body 1 are removed by the cleaning blade 7 and electric charges remaining on the surface of the image carrying body 1 are removed by the neutralizing device 8. Further, toner attached to the developing device 4 is removed by a scratching device 9 after passing through a developing area D.

In such a conventional image forming apparatus, however, stains are sometimes produced by ions having the polarity opposite to that of toner remaining on the surface of the developing device 4 and particularly when a vertically long continuous image is printed, stains are produced remarkably.

Causes that such stains are produced are now described in detail with reference to FIGS. 12 to 14. When toner charged to a positive polarity (+) is used as the liquid developing solution to form the toner image 12 on the image carrying body 1, a developing electric field 18 is formed toward the image carrying body 1 from the developing electrode 4 by a potential difference between the image carrying body 1 and the developing electrode 4 in an image forming area K as shown in FIG. 12 and toner particles 19 charged to the positive polarity (+) are moved toward the surface of the image carrying body 1 by the developing electric field 18 to be attached thereto. Negative ions 20 having the opposite polarity to that of the toner are moved to the developing device 4 and attached thereto. The negative ions 21 of the opposite polarity attached to the developing device 4 are conveyed by flow of solvent 22 occurring between an end of the scratching device 9 and the surface of the developing device 4 as shown by arrow in FIG. 13. Part of the negative ions 21 is removed together with the solvent 22, although negative ions 23 existing near the surface of the developing device 4 pass under the scratching device 9 and are conveyed to the developing area D again while the ions are attached to the developing device 4.

When white or blank printing in which any image is not formed on the surface of the image carrying body 1 is performed while the negative ions 23 are attached to the developing device 4 as described above, a potential on the surface of the image carrying body 1 is higher than the developing device 4. Accordingly, a developing electric field 24 is formed toward the developing device 4 from the image developing body 1 as shown in FIG. 14. The toner particles 19 charged to the positive polarity (+) are moved toward the surface of the developing device 4 by the developing electric field 24 and attached thereto. Toner particles 25 charged to a negative polarity (−), that is, toner particles 25 having a reversed polarity are produced by the negative ions 23 existing on the surface of the developing device 4 and the toner particles 25 of the negative polarity are moved to the image carrying body 1 and attached thereto by the developing electric field 24, so that there is a case where stains are produced in a printed white portion.

Particularly, when a vertically long continuous image is printed, the negative ions 23 of the opposite polarity to that of the toner are fed to the developing device 4 continuously and the density of the negative ions attached to the surface of the developing electrode is increased. Accordingly, stains due to the toner of the opposite polarity are easily produced on the white portion after the vertically long continuous image is printed.

In order to cope with such a problem, heretofore, the accuracy of the end portion of the cleaning blade 7 of the developing device 4 is improved to increase the scratching performance while the cleaning blade 7 is exchanged immediately when the cleaning blade 7 is worn. Accordingly, there are large problems that the period that the cleaning blade 7 is worn is shortened with increase of the printing speed and the maintenance cost is increased.

OBJECT AND SUMMARY OF THE INVENTION

The present invention has been made in view of the above problems and it is an object of the present invention to provide an image forming apparatus which can prevent stains produced by ions of an opposite polarity to toner attached to the surface of a developing device (developing electrode) and obtain satisfactory image quality over a long term.

In order to achieve the above object, according to the present invention, the image forming apparatus including at least an image carrying body, electrostatic latent image forming means for forming an electrostatic latent image on a surface of the image carrying body, rotary developing means for feeding liquid developing solution to the electrostatic latent image to form a toner image, scratching means for removing liquid developing solution attached to a surface of the developing means after the developing means has passed through a developing area, removing means for removing liquid developing solution remaining on the surface of the image carrying body after the toner image is formed, and transferring means for transferring the toner image formed on the surface of the image carrying body to a surface of a transfer material, comprises electric field applying means disposed in a position opposite to the surface of the developing means within an area defined until the surface of the rotary developing means reaches a position of the scratching means after the surface of the developing means has passed through the developing area so as to apply an electric field in a direction in which ions having a polarity opposite to that of toner particles are separated from the surface of the developing means.

Further, according to the present invention, the image forming apparatus comprises feeding means disposed in a gap between the electric field applying means and the developing means or a contact portion of the electric field applying means and the developing means for feeding liquid developing solution or solvent for developing liquid.

Furthermore, according to the present invention, in the image forming apparatus including at least an image carrying body, electrostatic latent image forming means for forming an electrostatic latent image on a surface of the image carrying body, rotary developing means for feeding liquid developing solution to the electrostatic latent image to form a toner image, scratching means for removing liquid developing solution attached to a surface of the developing means after the developing means passes through a developing area, removing means for removing liquid developing solution remaining on the surface of the image carrying body after the toner image is formed, and transferring means for transferring the toner image formed on the surface of the image carrying body to a surface of a transfer material, the scratching means includes an electric field applying function for applying an electric field in a direction in which ions having a polarity opposite to that of toner particles are separated from the surface of the developing means.

Moreover, according to the present invention, the image forming apparatus including at least an image carrying body, electrostatic latent image forming means for forming an electrostatic latent image on a surface of the image carrying body, rotary developing means for feeding liquid developing solution to the electrostatic latent image to form a toner image, scratching means for removing liquid developing solution attached to a surface of the developing means after the developing means has passed through a developing area, removing means for removing liquid developing solution remaining on the surface of the image carrying body after the toner image is formed, and transferring means for transferring the toner image formed on the surface of the image carrying body to a surface of a transfer material, comprises electric field applying means disposed in a position opposite to the surface of the developing means within an area defined until the surface of the rotary developing means reaches the developing area after the surface of the developing means has passed by the scratching means so as to apply an electric field in a direction in which ions having a polarity opposite to that of toner particles are separated from the surface of the developing means.

DETAILED DESCRIPTION OF PREFERRED EMBODIMENTS

Figure 1:
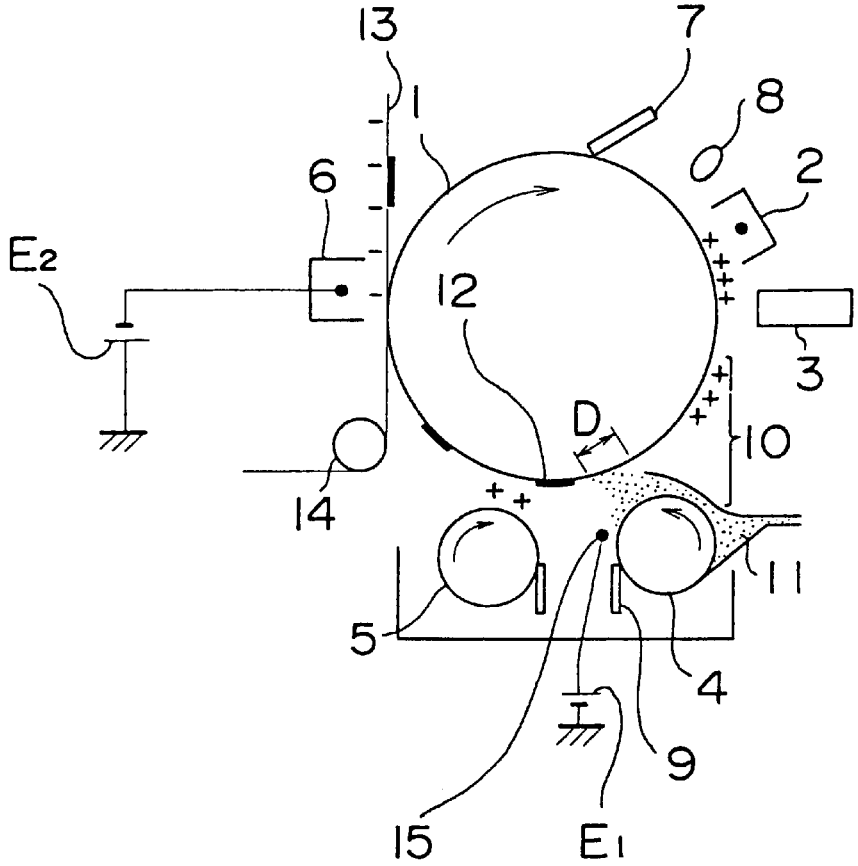
FIG. 1 schematically illustrates an image forming apparatus according to a first embodiment of the present invention.

Embodiments of the present invention are now described with reference to FIGS. 1 to 10. In FIGS. 1 to 10, the same elements as those of FIGS. 11 to 14 are designated by the same reference numerals and description thereof is omitted.

FIG. 1 schematically illustrates a first embodiment of an image forming apparatus to which the present invention is applied. In the image forming apparatus according to the first embodiment, an electric field applying electrode 15 is disposed between the developing area D and the scratching device 9 as electric field applying means. That is, the electric field applying electrode 15 is disposed, as the electric field applying means, in the position opposite to the surface of the developing device 4 within an area defined until the surface of the developing device 4 reaches the position of the scratching device (scratching means) 9 after the surface of the rotary developing device (developing means) 4 passes through the developing area D so as to apply the electric field in the direction in which ions having the polarity opposite to that of the toner are separated from the surface of the developing device 4.

Figure 2A:
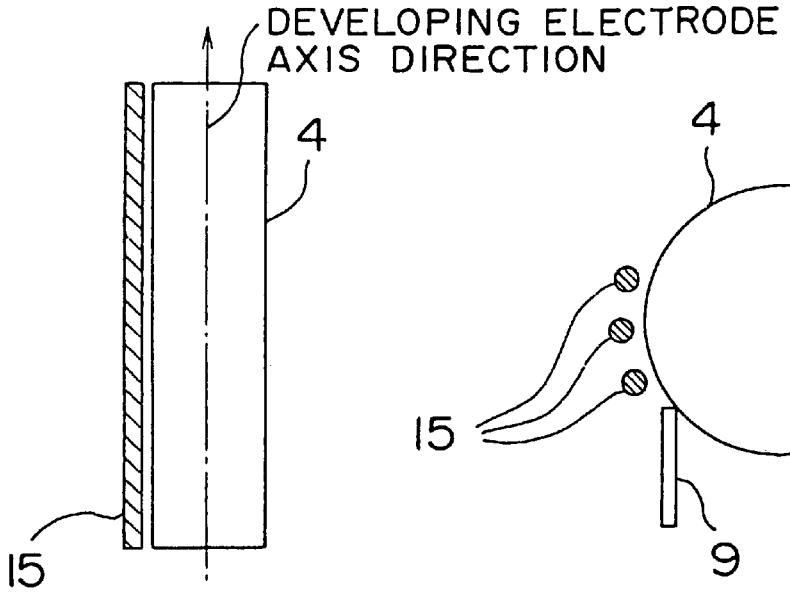
FIG. 2 shows an electric field applying electrode (electric field applying means) provided in the image forming apparatus according to the first embodiment of the present invention, in which FIG. 2(*a*) is a plan view showing the electric field applying electrode positioned opposite to a developing device and FIG. 2(*b*) is a side view showing the electric field applying electrode.
Figure 2B:
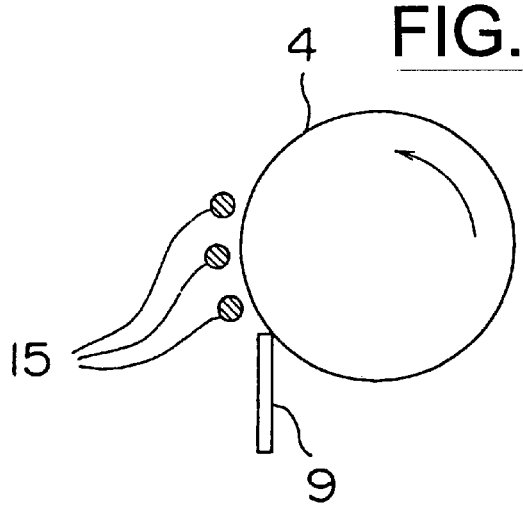

The electric field applying electrode 15 is an example effective for applying the electric field to separate ions attached to the surface of the developing device 4 from the surface. The electric field applying electrode 15 may use, for example, wire or rod or plate-like electrode. In the embodiment, as shown in FIGS. 1 or 2(*a*), the electric field applying electrode 15 made of a single wire or rod electrode is disposed in parallel along the axial direction of the developing device 4 with slight gap between the surface of the developing device 4 and the electrode opposite to the surface. Further, as shown in FIG. 2(*b*), a plurality of electric field applying electrodes 15 may be disposed along the peripheral direction of the developing device 4. The electric field applying electrode 15 is connected to a power supply $E_1$ as shown in FIG. 1 and a DC voltage or an AC voltage to which a DC voltage is superposed is applied to the electric field applying electrode 15 from the power supply $E_1$. Thus, as shown in FIG. 3, an electric field 26 for separating negative ions 21 attached to the surface of the developing device 4, that is, the electric field 26 produced from the image carrying body 1 toward the developing device 4 is formed (produced) in the area between the electric field applying electrode 15 and the developing device 4.

Figure 3:
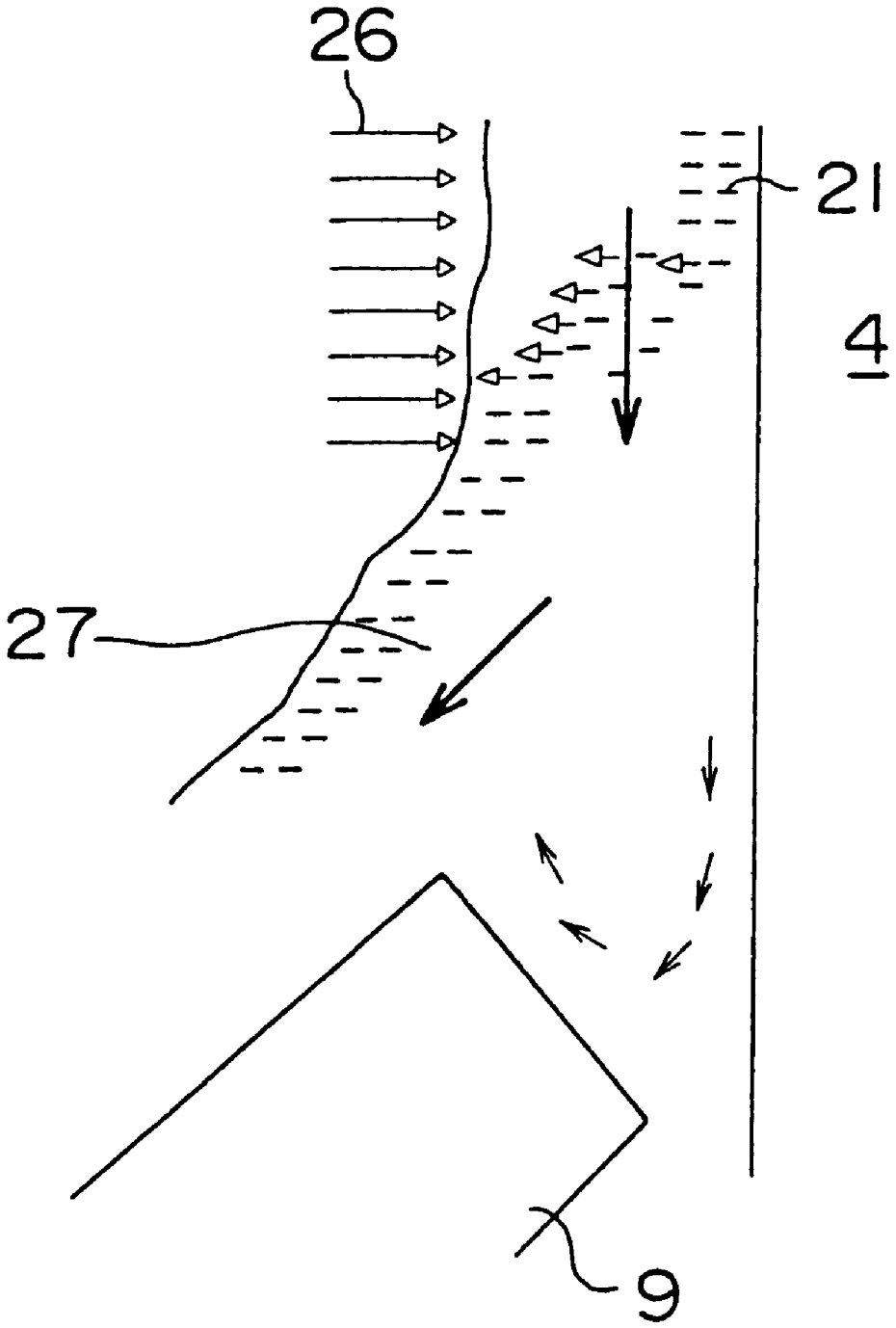
FIG. 3 is a diagram for explaining the effect that negative ions attached to the surface of the developing device are separated in the image forming apparatus according to the first embodiment of the present invention.

According to the image forming apparatus as structured above, since the electric field applying electrode 15 disposed in the area defined until the surface of the developing device 4 reaches the position of the scratching device 9 after the surface of the developing device 4 passes through the developing area D applies the electric field 26 so as to separate the negative ions 21 attached to the surface of the developing device 4 from the surface, the negative ions are concentrated in the solution 27 scratched off by the scratching device 9, so that a large number of negative ions are scratched off together with the solution 27 (see FIG. 3). Consequently, an amount of negative ions on the surface of the developing device 4 which has passes by the scratching device 9 can be reduced, so that stains can be prevented from being produced in the printed white portion.

Figure 4:
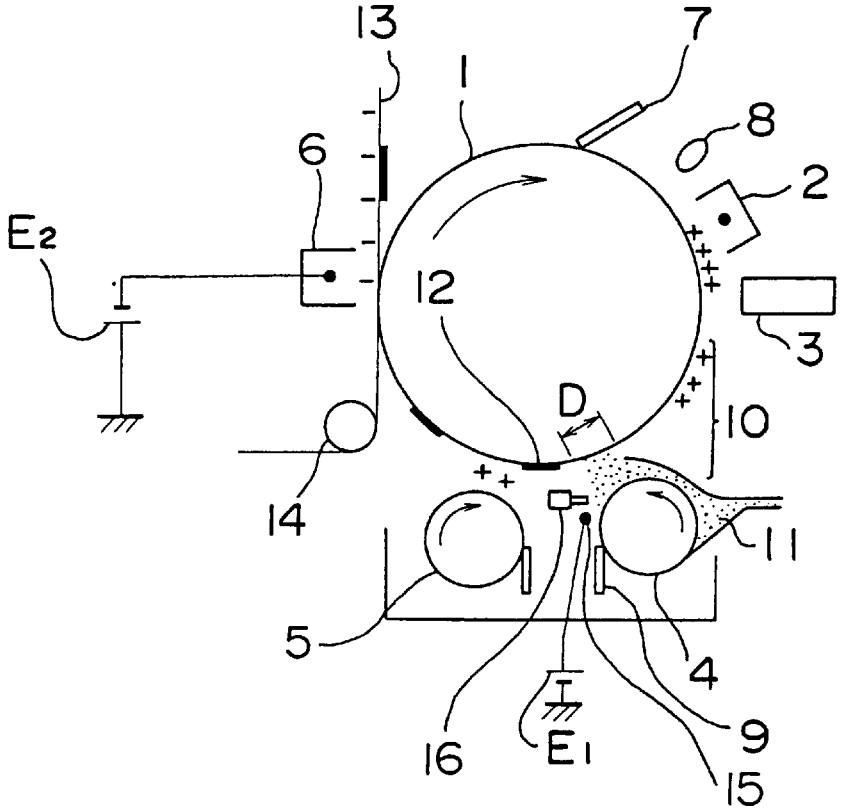
FIG. 4 schematically illustrates an image forming apparatus according to a second embodiment of the present invention.
Figure 5:
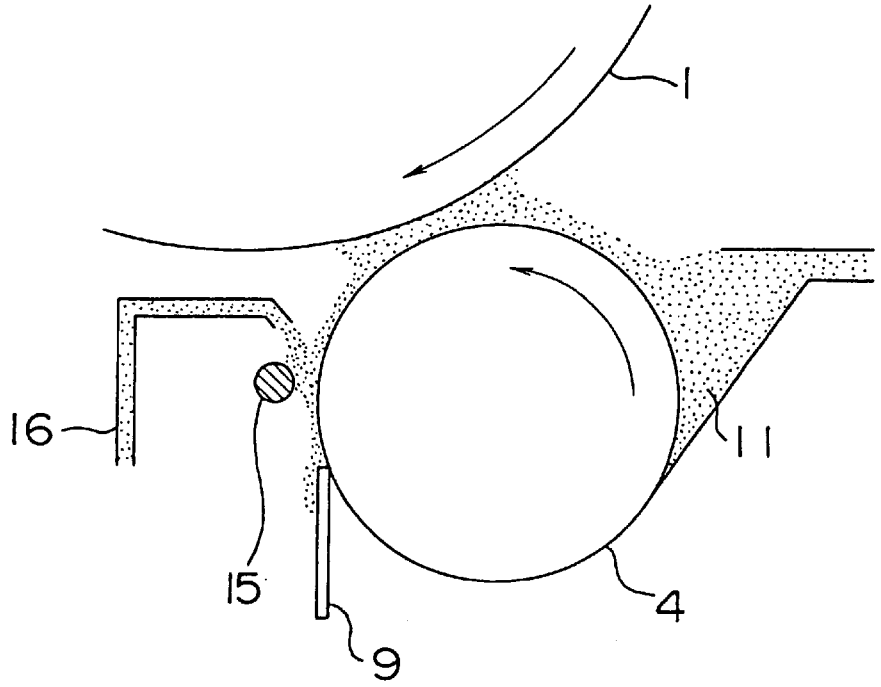
FIG. 5 is a plan view showing a developing liquid feeding device for feeding developing liquid into a space between the developing device and the electric field applying electrode.
Figure 6:
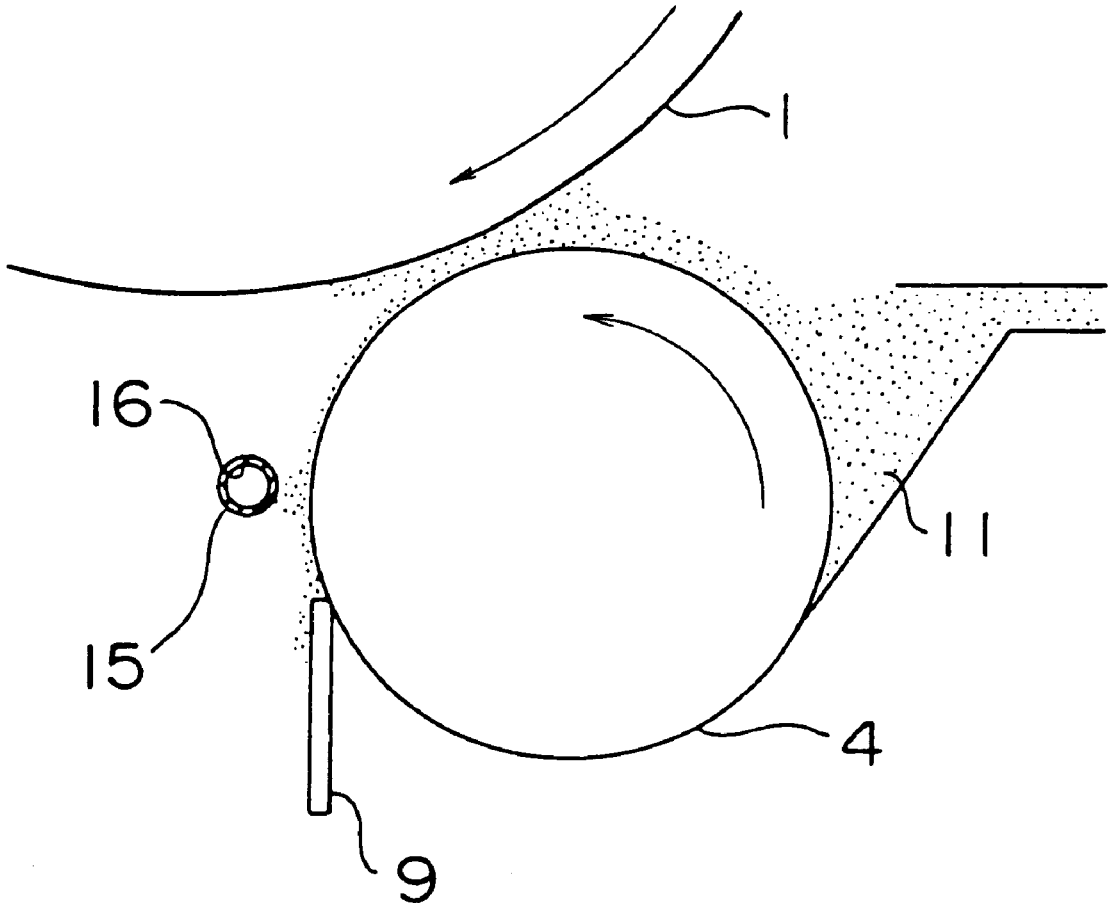
FIG. 6 is a plan view similar to FIG. 5 showing a modification of the developing liquid feeding device.

Referring now to FIG. 4, an image forming apparatus according to a second embodiment of the present invention is described. The image forming apparatus according to the second embodiment includes a developing liquid feeding device 16 disposed to feed developing liquid (liquid developing solution) to a gap between the electric field applying electrode 15 and the developing device 4 of the image forming apparatus or a contact portion of the electric field applying electrode 15 and the developing device 4 as shown in FIG. 4. The developing liquid feeding device 16 is an example of effective means for facilitating to separate ions attached on the surface of the developing device 4 from the surface of the developing device 4 by means of the electric field produced by the electric field applying electrode 15. The developing liquid feeding device 16 may be of a nozzle type as shown in FIG. 5, by way of example and may be formed integrally with the electric field applying electrode 15. That is, the electric field applying electrode 15 in the form of pipe as shown in FIG. 6 is used and developing liquid is fed from the inside of the electric field applying electrode 15 so that the function of the developing liquid feeding device 16 can be provided in the electric field applying electrode 15.

According to the image forming apparatus of the second embodiment as structured above, the developing liquid feeding device 16 is provided to feed the developing liquid between the electric field applying electrode 15 and the developing device 4, so that sufficient liquid film can be formed between the electric field applying electrode 15 and the developing device 4 to thereby separate the negative ions in the vicinity of the developing device 4 from the surface of the developing device 4 in the distance. Accordingly, an amount of negative ions on the surface of the developing device 4 which has passed by the scratching device 9 can be reduced more effectively.

Figure 7:
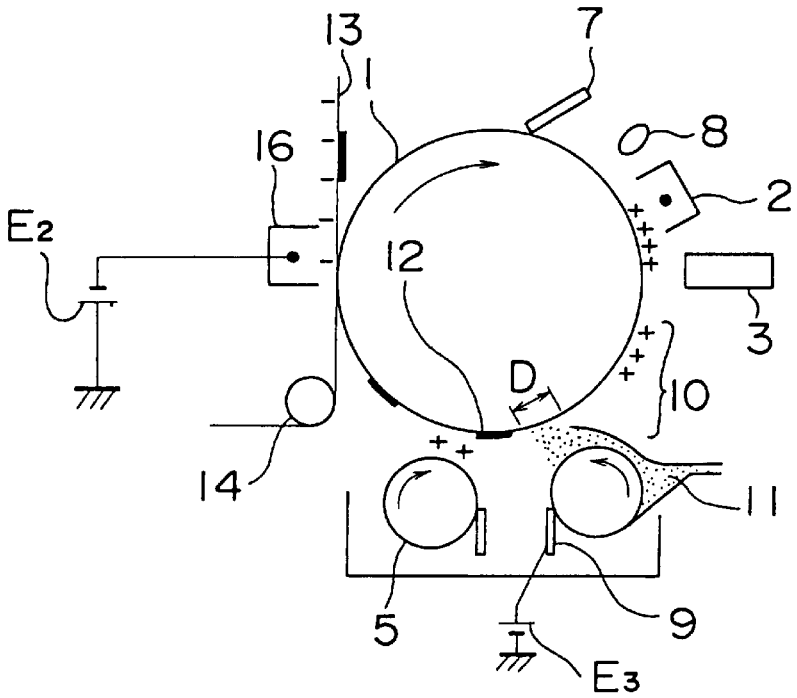
FIG. 7 schematically illustrating an image forming apparatus according to a third embodiment of the present invention.
Figure 8:
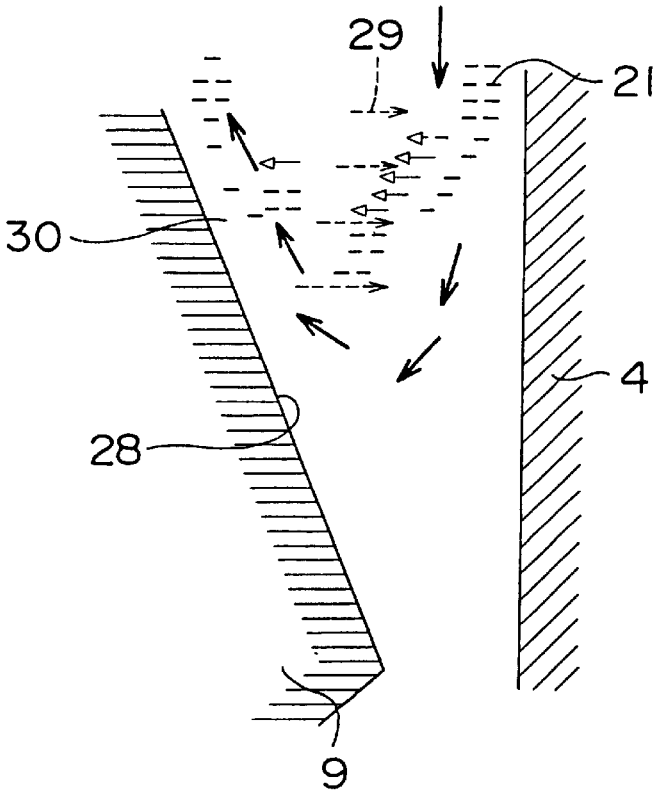
FIG. 8 is a diagram for explaining the effect that negative ions attached to the surface of the developing device are separated in the image forming apparatus according to the third embodiment of the present invention.

Referring now to FIG. 7, an image forming apparatus according to a third embodiment of the present invention is described. In the image forming apparatus according to the third embodiment, an electric potential for producing an electric field in the direction in which ions having a polarity opposite to that of toner particles are separated from the surface of the developing device 4 is applied to the scratching device 9 for removing the liquid developing solution 11 attached to the surface of the developing device 4, so that the electric field applying function is provided in the scratching device 9. Such a scratching device 9 applied with the electric potential is an example of effective means for applying the electric field to separate the negative ions attached to the surface of the developing device 4 from the surface of the developing device 4. A semiconductive rubber blade is effective for the electric potential applied scratching device 9. The scratching device 9 is connected to a power supply $E_3$ so as to apply the electric potential as shown in FIG. 7 and a DC voltage or an AC voltage to which a DC voltage is superposed is applied to the scratching device 9 from the power supply $E_3$. Thus, as shown in FIG. 8, the electric field 29 formed from the surface 28 of the leading end (scratching portion) of the scratching device 9 toward the surface of the developing device 4, that is, the electric field 29 for separating the negative ions 21 from the surface of the developing device 4 is applied between the developing device 4 and the scratching device 9.

According to the image forming apparatus of the third embodiment, the electric field 29 for separating the negative ions 21 attached to the surface of the developing device 4 is applied between the surface 28 of the leading end of the scratching device 9 to which the electric potential is applied and the developing device 4 by means of the electric field applying function included in the scratching device 9. Thus, negative ions are concentrated in the solution 30 scratched by the scratching device 9, that is, in the flow of the solution 30 shown by arrows in FIG. 8 by the function of the electric field 29, so that a large number of negative ions are scratched off together with the solution 30. Consequently, an amount of negative ions on the surface of the developing device 4 which has passed by the scratching device 9 can be reduced, so that stains can be prevented from being produced in the printed white portion.

Figure 9:
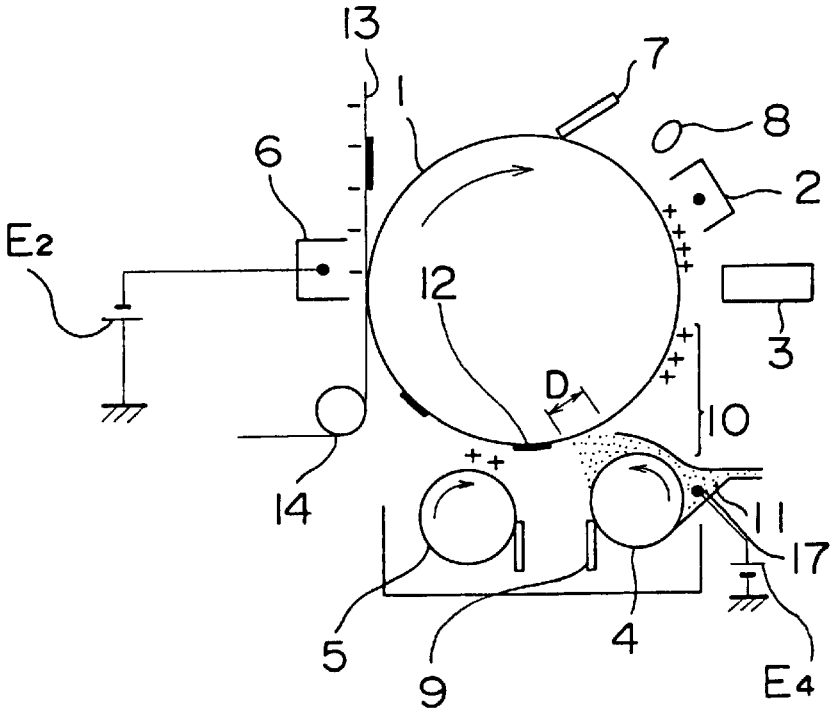
FIG. 9 schematically illustrates an image forming apparatus according to a fourth embodiment of the present invention.
Figure 10:
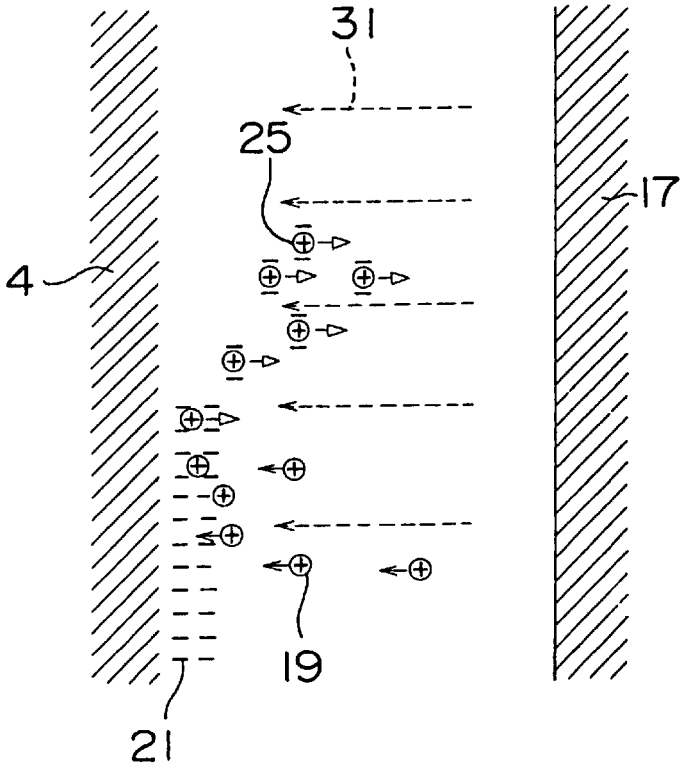
FIG. 10 is a diagram for explaining the effect that negative ions attached to the surface of the developing device are separated in the image forming apparatus according to the fourth embodiment of the present invention.
Figure 11:
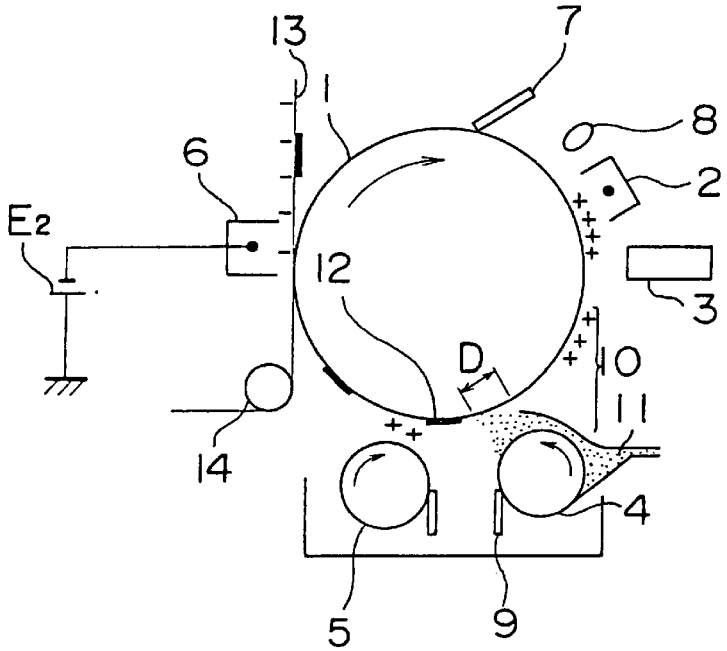
FIG. 11 RELATED ART
FIG. 11 schematically illustrates a conventional image forming apparatus.
Figure 12:
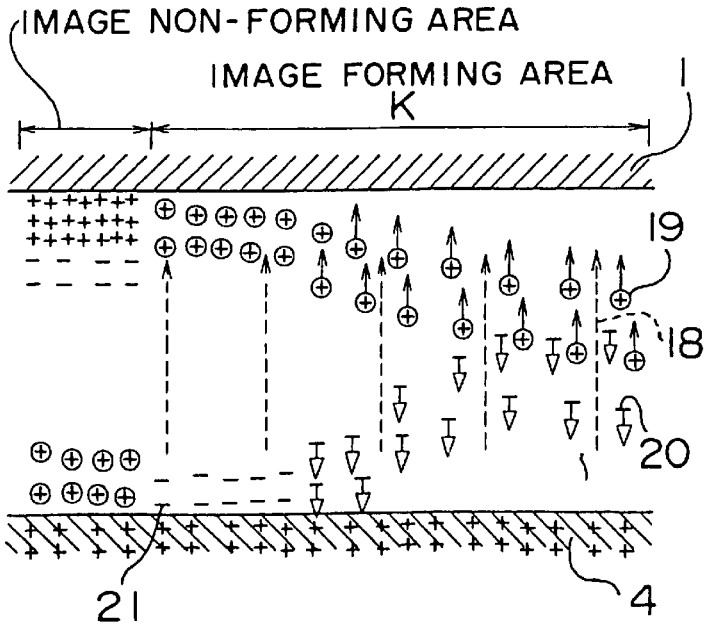
FIG. 12 RELATED ART
FIG. 12 is a diagram for explaining occurrence circumstances of stains in case where the conventional image forming apparatus is used.
Figure 13:
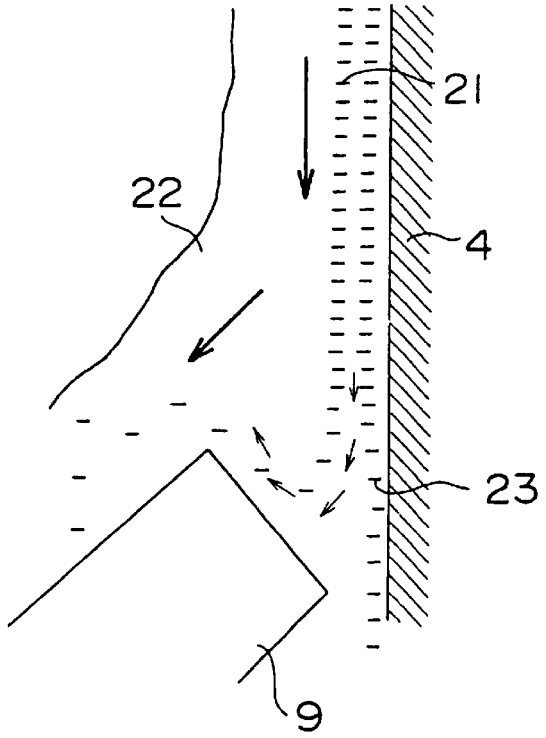
FIG. 13 RELATED ART
FIG. 13 is a diagram for explaining ions which are not scratched (not removed from the surface of the developing device) by a scratching device.
Figure 14:
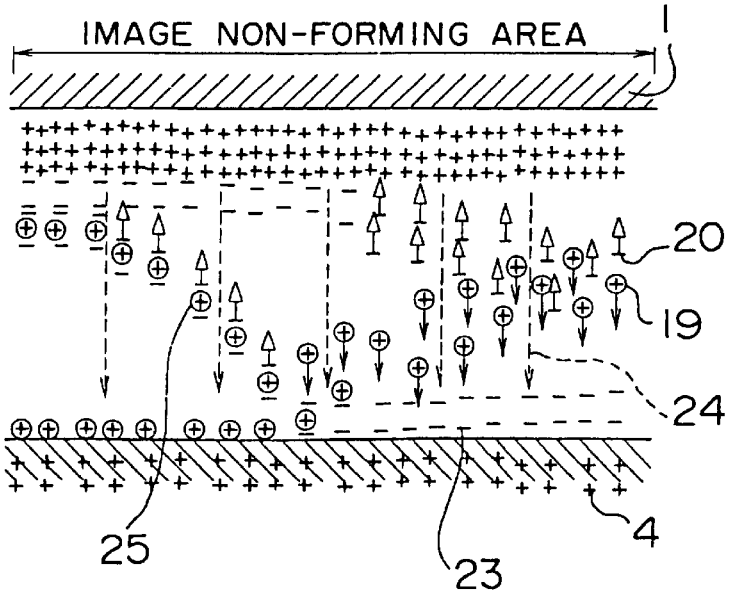
FIG. 14 RELATED ART
FIG. 14 is a diagram for explaining the fact that ions having an opposite polarity to toner are attached to the surface of a developing device in an image non-forming area.

Referring now to FIG. 9, an image forming apparatus according to a fourth embodiment of the present invention is described. In the image forming apparatus according to the fourth embodiment, as shown in FIG. 9, an electric field applying electrode 17 for applying an electric field 31 (see FIG. 10) in the direction in which ions having a polarity opposite to that of toner particles are separated from the surface of the developing device 4 is disposed, as electric field applying means, in a position opposite to the surface of the developing device 4, that is, in an area in which developing liquid is fed, within an area defined until the surface of the rotary developing device 4 reaches the developing area D after the surface of the developing device 4 passes by the scratching device 9. The electric field applying electrode 17 is an example effective for applying the electric field 31 in the direction in which the negative ions 21 (see FIG. 10) attached to the surface of the developing device 4 are separated from the surface of the developing device 4. Wire or rod or plate-like electrode is effective for the electric field applying electrode 17. The electrode 17 is connected to a power supply $E_4$ as shown in FIG. 9 and a DC voltage or an AC voltage to which a DC voltage is superposed is applied to the electric field applying electrode 17 from the power supply $E_4$, so that the electric field 31 is formed from the electric field applying electrode 17 toward the developing device 4, that is, the electric field 31 is formed in the direction in which the negative ions 21 are separated from the surface of the developing device 4.

According to the image forming apparatus of the fourth embodiment, the electric field 31 serving to move positive (+) toner particles 19 toward the developing device 4 and attach the toner particles 19 thereto is formed between the electric field applying electrode 17 and the developing device 4, so that negative (−) ions 21 attached to the surface of the developing device 4 and the positive (+) toner particles 19 can be coupled with each other to thereby produce toner particles 25 having the negative (−) polarity or reversed polarity. The toner particles 25 having the reversed polarity are separated from the surface of the developing device 4 by operation of the electric field 31 and are dispersed in the liquid developing solution 11. The toner particles 25 can carry away the negative ions 21 on the surface of the developing device 4 to thereby reduce an amount of negative ions on the surface of the developing device 4 which has reached the developing area D, so that stains can be prevented from being produced in the printed white portion.

The embodiments of the present invention have been described, while the present invention is not limited to the embodiments and various modifications and variations thereto may be made on the basis of the technical idea of the present invention. For example, in the above-described embodiments, the positively (+) charged toner is used as the liquid developing solution 11 and the surface of the image carrying body 1 is charged to the positive (+), with negative electric charges 17 having the polarity opposite thereto being applied to the rear surface of the transfer material 13, whereas even when a negatively (−) charged toner is used as the liquid developing solution 11 and the surface of the image carrying body 1 is charged to the negative (−), with positive electric charges having the polarity opposite thereto being applied to the rear surface of the transfer material 13, the present invention can be applied thereto. In this case, the direction of the electric fields 26, 29 and 31 in the first to fourth embodiments may be set to be opposite.

In the present invention as set forth in claim 1, since the electric field applying means for applying the electric field in the direction in which ions having the polarity opposite to that of the toner particles are separated from the surface of the developing means is provided in the position opposite to the surface of the developing means within the area defined until the surface of the rotary developing means reaches the position of the scratching means after the surface of the developing means passes through the developing area, ions (ions having the polarity opposite to that of the toner particles) attached to the surface of the developing means can be separated from the surface thereof by the operation of the electric field applied by the electric field applying means. Consequently, since the ions are concentrated in the liquid developing solution scratched by the scratching means, so that a large number of ions are scratched off together with the solution, an amount of negative ions on the surface of the developing means which has passed by the scratching means can be reduced, so that stains can be prevented from being produced in the printed white portion.

Further, in the present invention as set forth in claim 2, since the feeding means for feeding the liquid developing solution is disposed in the gap between the electric field applying means and the developing means or in the contact portion of the electric field applying means and the developing means, sufficient liquid film is formed between the electric field applying means and the developing means by the liquid developing solution fed from the feeding means and ions having the polarity opposite to that of the toner can be separated in the distance from the surface of the developing means. Accordingly, an amount of negative ions on the surface of the developing means which has passed by the scratching means can be reduced effectively.

In addition, in the present invention as set forth in claim 3, since the scratching means includes the electric field applying function for applying the electric field in the direction in which ions having the polarity opposite to that of the toner particles are separated from the surface of the developing means, ions having the polarity opposite to that of toner are concentrated in the developing solution scratched by the scratching means by the electric field applying function of the scratching means, so that a large number of ions are scratched off together with the solution. Consequently, an amount of ions on the surface of the developing means which has passed by the scratching means can be reduced, so that stains can be prevented from being produced in the printed white portion.

Furthermore, in the present invention as set forth in claim 4, since the electric field applying means for applying the electric field in the direction in which ions having the polarity opposite to that of toner particles are separated from the surface of the developing means is disposed in the position opposite to the surface of the developing means within the area defined until the surface of the rotary developing means reaches the developing area after the surface of the developing means passes by the scratching means, ions attached to the surface of the developing means and toner particles are coupled with each other by the operation of the electric field applied between the electric field applying means and the developing means, so that toner particles having the polarity opposite to that of the toner or having the reversed polarity can be formed and are separated from the surface of the developing means by the operation of the electric field to be dispersed in the liquid developing solution. Accordingly, since the ions on the surface of the developing means are carried away from the surface of the developing means together with the toner particles, an amount of ions on the surface of the developing means which has reached the developing area D can be reduced, so that stains can be prevented from being produced in the printed white portion.

As described above, according to the present invention as set forth in Claims, there can be provided the image forming apparatus in which stains produced by ions having the polarity opposite to that of the toner attached to the surface of the developing device (developing means) can be prevented and the satisfactory image quality can be obtained over a long term.

We claim:

1. An image forming apparatus comprising:

at least one image carrying body;

electrostatic latent image forming means for forming an electrostatic latent image on a surface of said image carrying body;

rotary developing means having an endless rotating surface for feeding liquid developing solution to said electrostatic latent image to form a toner image thereon;

scratching means positioned for removing liquid developing solution from the surface of said developing means after said developing means passes through a developing area defined on an adjacent surface of said image carrying body;

removing means positioned for removing liquid developing solution remaining on the surface of said image carrying body after said toner image has been formed;

transferring means positioned for transferring said toner image formed on the surface of said image carrying body to a surface of a transfer material; and electric field applying means disposed in a position opposite to the surface of said developing means between said developing area and said scratching means, positioned for applying an electric field to the surface of said developing means after the surface of said developing means passes through said developing area, until the surface of said rotary developing means reaches the position of said scratching means, wherein said electric field being applied to the surface of said developing means to separate ions having an electrical polarity opposite to that of toner particles from the surface of said developing means.

2. An image forming apparatus according to claim 1, comprising feeding means for feeding liquid developing solution, said feeding means disposed in a gap between said electric field applying means and said developing means.

3. An image forming apparatus according to claim 1, wherein said electric field applying means having a contact portion, and further comprising feeding means for feeding liquid developing solution, said feeding means disposed in a gap between the contact portion of said electric field applying means and said developing means.

4. An image forming apparatus comprising:

at least one image carrying body;

electrostatic latent image forming means for forming an electrostatic latent image on a surface of said image carrying body;

rotary developing means having an endless rotating surface for feeding liquid developing solution to said electrostatic latent image to form a toner image thereon;

scratching means positioned for removing liquid developing solution from the surface of said developing means after said developing means passes through a developing area defined on an adjacent surface of said image carrying body;

removing means positioned for removing liquid developing solution remaining on the surface of said image carrying body after said toner image has been formed;

transferring means positioned for transferring said toner image formed on the surface of said image carrying body to a surface of a transfer material; and electric field applying means disposed in a position opposite to the surface of said developing means between said developing area and said scratching means, positioned for applying an electric field to the surface of said developing means after the surface of said developing means has passed said scratching means, until the surface of said rotary developing means reaches said developing area, wherein said electric field being applied to the surface of said developing means to separate ions having an electrical polarity opposite to that of toner particles from the surface of said developing means.

5. An image forming apparatus comprising:

at least one image carrying body;

an electrostatic latent image exposure device to form an electrostatic latent image on a surface of said image carrying body;

a rotary developing device having an endless rotating surface to feed liquid developing solution to said electrostatic latent image to form a toner image thereon;

a scratching device positioned to remove liquid developing solution from a surface of said developing device after said developing device passes through a developing area defined on an adjacent area of said image carrying body;

a removing device positioned to remove liquid developing solution remaining on the surface of said image carrying body after said toner image has been formed;

a transferring device positioned to transfer said toner image formed on the surface of said image carrying body to a surface of a transfer material; and an electrode disposed in a position opposite to the surface of said developing device between said developing area and said scratching device, positioned to apply an electric field to the surface of said developing device after the surface of said developing device has passed through said developing area, until the surface of said rotary developing device reaches said scratching device, wherein said electric field being applied to the surface of said developing device to separate ions having an electrical polarity opposite to that of toner particles from the surface of said developing device.

6. An image forming apparatus according to claim 5, comprising a developing liquid feeding device disposed in a gap between said electrode and said developing device.

7. An image forming apparatus according to claim 5, wherein said electrode having a contact portion, and further comprising a developing liquid feeding device disposed in a gap between the contact portion of said electrode and said developing device.

8. An image forming apparatus comprising:

at least one image carrying body;

an electrostatic latent image exposure device to form an electrostatic latent image on a surface of said image carrying body;

a rotary developing device having an endless rotating surface to feed liquid developing solution to said electrostatic latent image to form a toner image thereon;

a scratching device positioned to remove liquid developing solution from a surface of said developing device after said developing device passes through a developing area defined on an adjacent surface of said image carrying body;

a removing device positioned to remove liquid developing solution remaining on the surface of said image carrying body after said toner image has been formed;

a transferring device positioned to transfer said toner image formed on the surface of said image carrying body to a surface of a transfer material; and an electrode disposed in a position opposite to the surface of said developing device between said developing area and said scratching device, positioned to apply an electric field to the surface of said developing device after the surface of said developing device has passed said scratching device, until the surface of said developing device reaches said developing area, wherein said electric field being applied to the surface of said developing device to separate ions having an electrical polarity opposite to that of toner particles from the surface of said developing device.

* * * * *